United States Patent [19]

Aimar

[11] 3,972,093

[45] Aug. 3, 1976

[54] BUTTON AND CONNECTING MEMBER ASSEMBLY

[75] Inventor: Michele Aimar, Turin, Italy

[73] Assignee: ITW Fastex Italia, S.p.A., Turin, Italy

[22] Filed: Mar. 18, 1975

[21] Appl. No.: 559,606

[30] Foreign Application Priority Data

Mar. 28, 1974 Italy ..... 49812/74

[52] U.S. Cl. ..... 24/90 B; 5/356; 24/230.5 TP

[51] Int. Cl.[2] ..... A44B 1/18; A44B 13/00

[58] Field of Search ..... 5/356; 24/102 T, 90 B, 24/237, 230.5 TP, 230.5 CR

[56] References Cited

UNITED STATES PATENTS

| | | | |
|---|---|---|---|
| 974,857 | 11/1910 | Brock | 24/230.5 CR |
| 1,963,710 | 6/1934 | Mitchell | 5/356 UX |
| 2,048,277 | 7/1936 | Mays | 24/230.5 TP |
| 2,262,161 | 11/1941 | Blumstock | 5/356 X |
| 2,787,435 | 4/1957 | Shields | 24/237 UX |
| 3,829,935 | 8/1974 | Critchfield | 24/90 B |
| 3,879,807 | 4/1975 | Casale | 24/102 T |

FOREIGN PATENTS OR APPLICATIONS

| | | | |
|---|---|---|---|
| 738,003 | 10/1932 | France | 5/356 |
| 626,941 | 10/1961 | Italy | 24/237 |

*Primary Examiner*—Donald A. Griffin

*Attorney, Agent, or Firm*—Jack R. Halvorsen; Robert W. Beart

[57] ABSTRACT

A button and connecting member assembly is described wherein the connecting member is in the form of an elongated ring and the button has a projection in the form of a spring catch. Both members are made integrally from a plastic material.

4 Claims, 3 Drawing Figures

BUTTON AND CONNECTING MEMBER ASSEMBLY

This invention relates generally to buttons for fastening the stuffing of a seat to the frame thereof and more particularly a button and member assembly adapted to this purpose.

Known buttons of this type are usually provided at lower portion thereof with an eye member into which a cord or the like can be threaded. In order to fasten the stuffing to the seat frame, a cord is secured to the eye of each button, which cord is then caused to pass through a bore in the stuffing and finally, after the cord has been suitably pulled so as to compress the stuffing, it is fastened to the seat frame by means of a knot or other suitable means. The assembly of these buttons is time-consuming, a constant thickness of stiffing cannot be achieved in a simple manner once the buttons are mounted and, if the buttons are fastened by means of knots, a take-off thereof from the stuffing may occur.

The object of the present invention is to provide a button and connecting member assembly for fastening the stuffing of a seat to the frame thereof which avoids these disadvantages.

More particularly the button and connecting member assembly according to this invention is characterized in that the connecting member is formed of an elongated ring intended to be hooked to the seat frame and the button is provided at the lower end thereof with a spring-catch-like hook for engagement to said ring.

According to another feature of this invention the button and the connecting member are each formed integrally from a plastic material.

This invention will be better understood from the following detailed description of an embodiment thereof, given merely by way of example and therefore in no limiting sense, taken in connection with the accompanying drawings, wherein.

Figure 2:
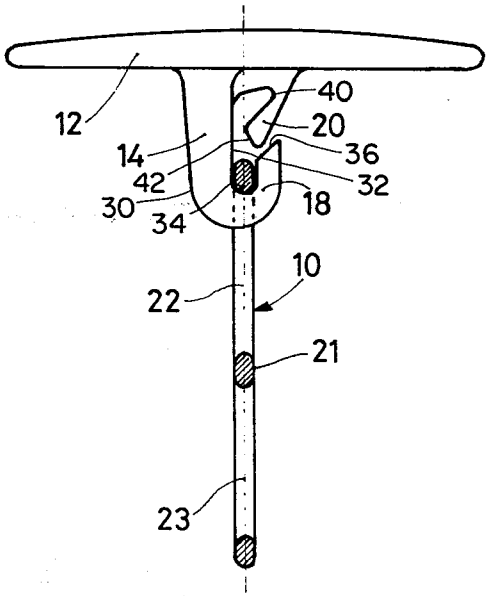
FIG. 2 is a sectional view, taken along the line 2—2 of FIG. 1, with the button not sectioned.
Figure 1:
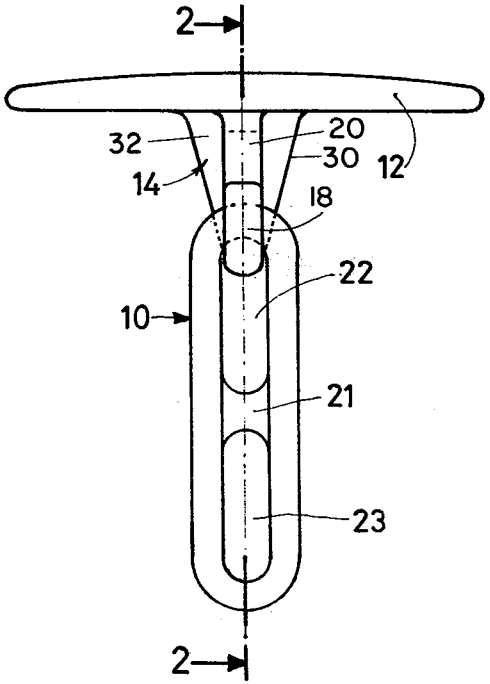
FIG. 1 is an elevation view of the button and connecting member in a hooked relationship.
Figure 3:
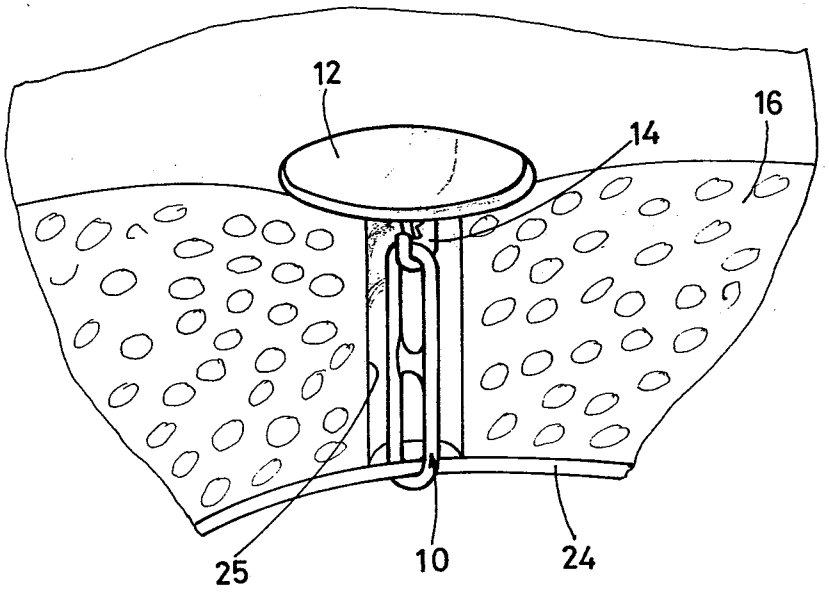
FIG. 3 is a diagrammatic view of the button and connecting member assembly in a mounted relationship.

Referring to the drawings, there is shown a connecting member 10 in the form of an elongated ring having the internal space separated by a crosspiece 21 in two eye portions 22, 23. The ring 10 is moulded preferably integrally from plastic material. Hooked to one of the eye portions of connecting member 10, e.g. the eye portion 22, is a button 12 having a lower projection in the form of a spring catch 14. Button 12 and projection 14 are also moulded integrally from plastic material. The projection 14 includes a stem 30 which is a generally rigid tapered element, in the present instance, it has a substantially flat face 32 and is positioned with its inner face 32 offset from the axis of the fastener, as seen in FIG. 2. The narrow end of the stem 30 terminates in a reversely bent hook portion 18 having a width substantially less than the tapered width of the stem 30. Hook 18 has its free end extended towards the head to provide a bight portion 34 facing the head or button 12. The free end of hook 18 terminates in a beveled surface 36 which tapers inwardly toward the bight portion 34. Extending in angular fashion downwardly from the head 12 is a finger 20 having a reduced cross section, designated by the numeral 40, which provides a hinge point about which finger 20 is capable of being moved. The free end 42 of finger 20 is also beveled in a direction opposite to the beveled surface 36, with the lower extremity being positioned below the upper extremity of beveled surface 36 and in opposition thereto. Thus, a throat is formed between the end 42 and the beveled surface 36 having a dimension substantially less than the fastening means or connecting member 10 for purposes set forth hereinafter.

In order to fasten a stuffing 16, for example formed of polyurethane foam, to a metallic frame of a seat, the connecting members 10 are first applied to the frame 24, with the eye portions 23 being inserted onto a part of the frame 24 and disposed in predetermined locations and then the stuffing 16 is placed upon the frame 24 and the connecting members 10 are inserted in bores 25 in the stuffing. Thereafter on each bore a button is applied with the projection 14 extending downwardly and then a pressure force is applied on the button so as to compress the stuffing 16 until the button is hooked to the eye portion 22 of the connecting member 10. Because of the particular spring-catch conformation of the projection 14 comprising a hook portion 18 and an elastic finger portion 20, the button can no longer be taken-off from the connecting member 10, once the button is hooked. When the connecting member 10 is inserted into the throat, the finger 20 is resiliently moved about its hinge point in one direction, in FIG. 2 this would be to the left of the viewer, to open up the throat and permit insertion of the connecting member 10. When the connecting member 10 is moved in the direction of release, it will first contact the beveled free end 42 of finger 20 and move the finger in a second direction to the right, as viewed in FIG. 2, and bend the finger 20 about its hinge point 40 until it comes in contact with the opposed beveled surface 36 thereby closing the throat and preventing unintentional removal of the connecting member 10. Should it be desired, for repair purposes or otherwise, to remove the button from the connecting member, this can be readily done by first moving the finger 20 in the first direction and thence removing the connecting member through the throat.

The advantages of the invention so far described are the following: the stuffing is mounted very rapidly, the thickness thereof at the various buttons is constant and the buttons cannot take-off by themselves.

While a single embodiment of the present invention has been described and shown it is obvious that various changes and modifications can be made thereto without departing from the scope of the invention.

What I claim is:

1. A one-piece button for cooperative engagement with fastening means in upholstery work, said button including a head and a tapered substantially rigid stem projecting from said head and terminating in a reversely bent hook means extending back toward said head to provide a bight portion facing said head, said hook portion terminating in a beveled surface which slants in the direction of said bight portion, a locking finger having a predetermined resilient hinge point extending angularly away from said head toward said bight and having its free end positioned below the upper extremity of said hook portion in spaced opposed relation to said beveled surface to form a throat having a limited predetermined opening size, the free end of said locking finger being beveled toward said beveled surface of said hook, said beveled surfaces of said hook and said finger lying in planes which are generally perpendicular to each other, said locking finger having means to limit the opening size of said throat, whereby introduction of said cooperative fastening means into said throat results in movement of said finger in one direction about said hinge point to increase said throat size for acceptance of fastening means into said bight while movement of fastening means in the opposite direction will close said throat by contact of the fastening means with the beveled free end of said finger and its resultant movement into contact with said beveled surface of said hook.

2. A button of the type claimed in claim 1 wherein said stem is a generally flat, rigid triangular shaped member with said hook means and said finger having widths that are substantially less than said stem.

3. A button of the type claimed in claim 1 in combination with a continuous elongated open ring connecting member.

4. A button and connecting member assembly as claimed in claim 3, characterized in that the ring includes a cross-piece separating the internal space of the ring into two portions, one of said portions to be cooperatively hooked to the frame of the object being upholstered and the other portion to the button.

* * * * *